US010287802B2

(12) United States Patent
Liu et al.

(10) Patent No.: US 10,287,802 B2
(45) Date of Patent: May 14, 2019

(54) ELECTROMAGNETIC OPENING DEVICE FOR SAFE DEPOSIT BOX

(71) Applicant: Suzhou Jinlin Metal Co., Ltd., Suzhou, Jiangsu (CN)

(72) Inventors: Andrew Liu, Jiangsu (CN); Smith Chen, Jiangsu (CN)

(73) Assignee: SUZHOU JINLIN METAL CO., LTD., Suzhou, Jiangsu (CN)

( * ) Notice: Subject to any disclaimer, the term of this patent is extended or adjusted under 35 U.S.C. 154(b) by 402 days.

(21) Appl. No.: 15/035,470

(22) PCT Filed: Dec. 5, 2014

(86) PCT No.: PCT/CN2014/093159

§ 371 (c)(1),
(2) Date: May 9, 2016

(87) PCT Pub. No.: WO2015/172554

PCT Pub. Date: Nov. 19, 2015

(65) Prior Publication Data

US 2016/0281401 A1 Sep. 29, 2016

(30) Foreign Application Priority Data

May 15, 2014 (CN) ..... 2014 1 0203464

(51) Int. Cl.

| | |
|---|---|
| ***E05B 47/00*** | (2006.01) |
| ***E05B 47/06*** | (2006.01) |
| ***E05B 65/00*** | (2006.01) |
| ***E05C 19/16*** | (2006.01) |
| ***E05G 1/00*** | (2006.01) |
| ***E05B 47/02*** | (2006.01) |
| ***E05B 15/00*** | (2006.01) |
| *A45C 1/12* | (2006.01) |

(52) U.S. Cl.

CPC ..... *E05B 47/0004* (2013.01); *E05B 15/0093* (2013.01); *E05B 47/026* (2013.01); (Continued)

(58) Field of Classification Search

CPC ..... E05B 15/0073; E05B 15/0093; E05B 17/2084; E05B 17/2088; E05B 17/2092; (Continued)

(56) References Cited

U.S. PATENT DOCUMENTS 5,090,751 A * 2/1992 Kobayashi ..... B60N 3/08 292/210
5,249,831 A * 10/1993 Maniaci ..... E05B 15/0093 109/59 R (Continued)

FOREIGN PATENT DOCUMENTS

CN 200946397 Y 9/2007
CN 201288456 Y 8/2009

(Continued)

*Primary Examiner* — Christine M Mills
(74) *Attorney, Agent, or Firm* — Andy M. Han; Han IP PLLC

(57) ABSTRACT

An electromagnetic opening device comprises a housing, a fixed iron core, a movable iron core having a bottom end engaging with the fixed iron core, a shaft sleeve that sleeves a top end of the movable iron core and extends outside of the housing, and an electromagnetic coil, and a vibration sensing mechanism comprising a sensing block having a rotation shaft, a stopping end and a balancing end located on two sides of the movable iron core. A bottom of the stopping end is rotationally connected onto the housing through the rotation shaft. When the sensing block compresses a balance spring disposed between the balancing end and the housing through the rotation of the rotation shaft, the stopping end abuts against the shaft sleeve. The vibration sensing mechanism effectively prevents a mistaken shrinkage of the shaft sleeve of the movable iron core and abnormally opening of a safe deposit box.

7 Claims, 6 Drawing Sheets

(52) U.S. Cl.
CPC ..... *E05B 47/06* (2013.01); *E05B 65/0075* (2013.01); *E05C 19/168* (2013.01); *E05G 1/005* (2013.01); *A45C 1/12* (2013.01); *E05B 2047/0093* (2013.01)

(58) Field of Classification Search
CPC ..... E05B 2047/0093; E05B 47/0002; E05B 47/0004; E05B 47/0003; E05B 47/026; E05B 47/06; E05B 47/0603; E05B 65/0075; E05B 65/0082; E05C 17/56; E05C 19/16; E05C 19/166; E05C 19/168; Y10T 292/11; Y10T 292/0969; Y10T 292/1014; Y10T 292/1021; Y10S 292/22; E05G 1/005; A45C 1/12
USPC ..... 292/251.5, 163, 138, 144, DIG. 22
See application file for complete search history.

(56) References Cited

U.S. PATENT DOCUMENTS 6,098,433 A * 8/2000 Maniaci ..... E05B 47/0002 292/144
7,007,524 B2 * 3/2006 Jasper ..... E05B 47/0607 292/92
7,424,814 B2 * 9/2008 Jasper ..... E05B 47/0607 292/92
7,900,979 B2 * 3/2011 Bragg ..... A47L 15/4259 292/137
2002/0011085 A1 * 1/2002 Rice ..... E05B 47/0688 70/33
2007/0000294 A1 * 1/2007 Umeda ..... F16H 61/22 70/195
2008/0073916 A1 * 3/2008 Min ..... E05B 47/0603 292/201
2010/0132418 A1 * 6/2010 Chen ..... E05B 47/0002 70/277

FOREIGN PATENT DOCUMENTS

CN 202401842 U 8/2012
CN 103075051 A 5/2013
CN 203050275 U 7/2013
CN 103967348 A 8/2014
CN 204002104 U 12/2014
DE 102012009067 B3 * 8/2013 ..... E05B 47/0047
KR 20090013165 U 12/2009

* cited by examiner

ELECTROMAGNETIC OPENING DEVICE FOR SAFE DEPOSIT BOX

CROSS REFERENCE TO RELATED PATENT APPLICATIONS

The present disclosure is a U.S. national stage application of PCT patent application PCT/CN2014/093159, filed on 5 Dec. 2014 and claiming the priority benefit of Chinese patent application 201410203464.2, filed on 15 May 2014. The aforementioned patent applications are incorporated by reference in their entirety.

TECHNICAL FIELD

The present disclosure relates to an electronic lock for a safe deposit box and, in particular, to an electromagnetic opening device for a safe deposit box.

BACKGROUND

An electronic lock for a safe deposit box generally comprises a key reading device, an electromagnetic opening device, and a bolt assembly. The key reading device is typically a password or fingerprint reading device, the electromagnetic opening device is primarily an electromagnet driven by an electromagnetic coil. The electromagnet is connected to and controlled by the key reading device. When the electromagnetic opening device is not powered on, the electromagnet extends out to block a bolt puling plate of the bolt assembly to prevent retraction of a spring bolt of the bolt assembly. After the key reading device has read a key and finished verification, the electromagnetic opening device will be energized to retract the electromagnet, and then an opening knob of the bolt assembly is rotated, thereby the bolt puling plate will drive the spring bolt to retract, and a door of the safe deposit box can be opened.

In general, in the electromagnetic opening device, a movable iron core is driven by an electromagnetic coil of an electromagnet, and a rebound spring structure is used to achieve locking and unlocking. Since a magnetism force of the electromagnet is limited and must be greater than an elastic force of a spring of the rebound spring structure, the elastic force of the spring shall not be too big. While if the elastic force of the spring is too small, in the event of shaking, knocking, shocking, etc., the movable iron core of the electromagnet may compress the spring under inertia effect of external force, thus invalidating a position-limit function against the bolt puling plate, and opening the safe deposit box abnormally, thereby greatly affecting stability and security of the safe deposit box.

SUMMARY

One object of the present disclosure is to provide an electromagnetic opening device for a safe deposit box with improved structure, thereby preventing mistaken opening of an electromagnet under external force and improving stability and security of the safe deposit box.

In order to solve above problem, an electromagnetic opening device for a safe deposit box is provided in the present disclosure comprises: a housing; a fixed iron core configured in the housing; a movable iron core configured in the housing and having a bottom end engaging with the fixed iron core; a shaft sleeve configured for sleeving a top end of the movable iron core and extending outside of the housing through a through hole in the housing; an electromagnetic coil, a paddle and a closed spring configured in the housing. The electromagnetic opening device further comprises: a vibration sensing mechanism configured in the housing and comprising a sensing block having a stopping end and a balancing end located on two opposite sides of the movable iron core respectively, and a balance spring configured between a bottom of the balancing end and the housing. A bottom of the stopping end is rotationally connected onto the housing through a rotation shaft. When the sensing block compresses the balance spring through the rotation of the rotation shaft, the stopping end is driven to abut against a bottom surface of the shaft sleeve.

In the above technical solution, the housing has a block and a front end of the block engages against the stopping end.

In the above technical solution, the sensing block is provided with a U-shaped groove, the movable iron core is located within the U-shaped groove, gaps are defined between sidewalls of the U-shaped groove and the movable iron core, and the stopping end and the balancing end are located on two opposite sides of the U-shaped groove.

In the above technical solution, a mounting hole receiving one end of the balance spring is defined on a bottom of the balancing end.

In the above technical solution, a central dividing baffle is provided in a cavity defined by the housing, the vibration sensing mechanism is located above the dividing baffle, and the electromagnetic coil and the fixed iron core are located below the dividing baffle.

In the further technical solution, a bottom of the balance spring is fixed to the dividing baffle.

Due to the application of the above mentioned technical solution, the present disclosure has a number advantages compared with the existing techniques, as explained below.

1. The present disclosure is added with a vibration sensing mechanism, which comprises a sensing block rotationally connected onto the housing through a rotation shaft and a balance spring on another side of the rotation shaft. In the event of shaking, knocking, shocking, etc. to the safe deposit box, the balancing end of the sensing block may compress the balance spring under inertia effect, and the sensing block may rotate counterclockwise around the rotation shaft, then the stopping end lifts to abut against the shaft sleeve of the movable iron core, to prevent it to go downward under inertia effect, thereby avoiding unlocking of the safe deposit box abnormally, and greatly increasing stability and security of the safe deposit box.

2. A block is provided on the housing at the side of the stopping end, to prevent reverse rotation of the sensing block, thus to ensure stability and reliability of the operation of the sensing block.

Figure 1:
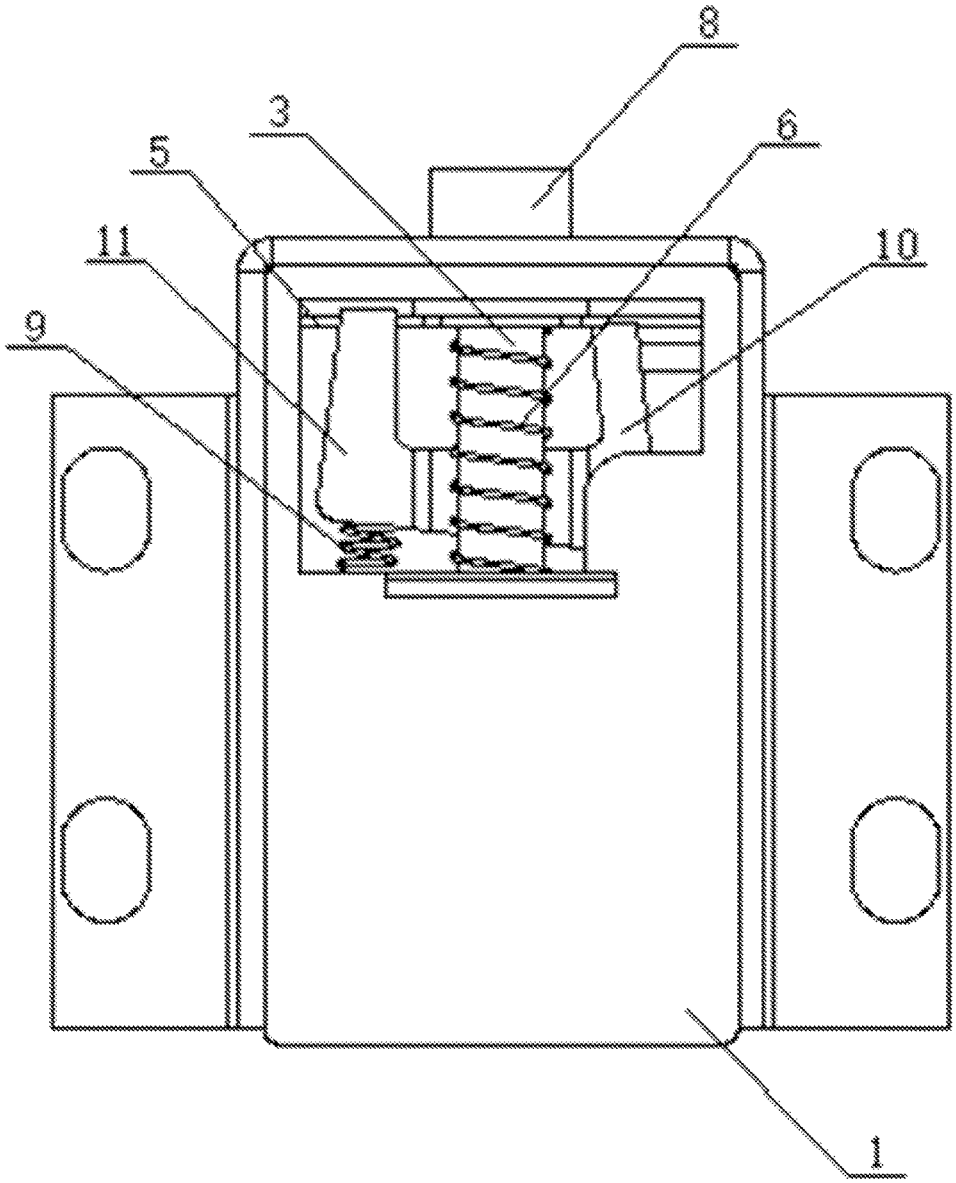
FIG. 1 is a structure diagram of an embodiment of the present disclosure.
Figure 2:
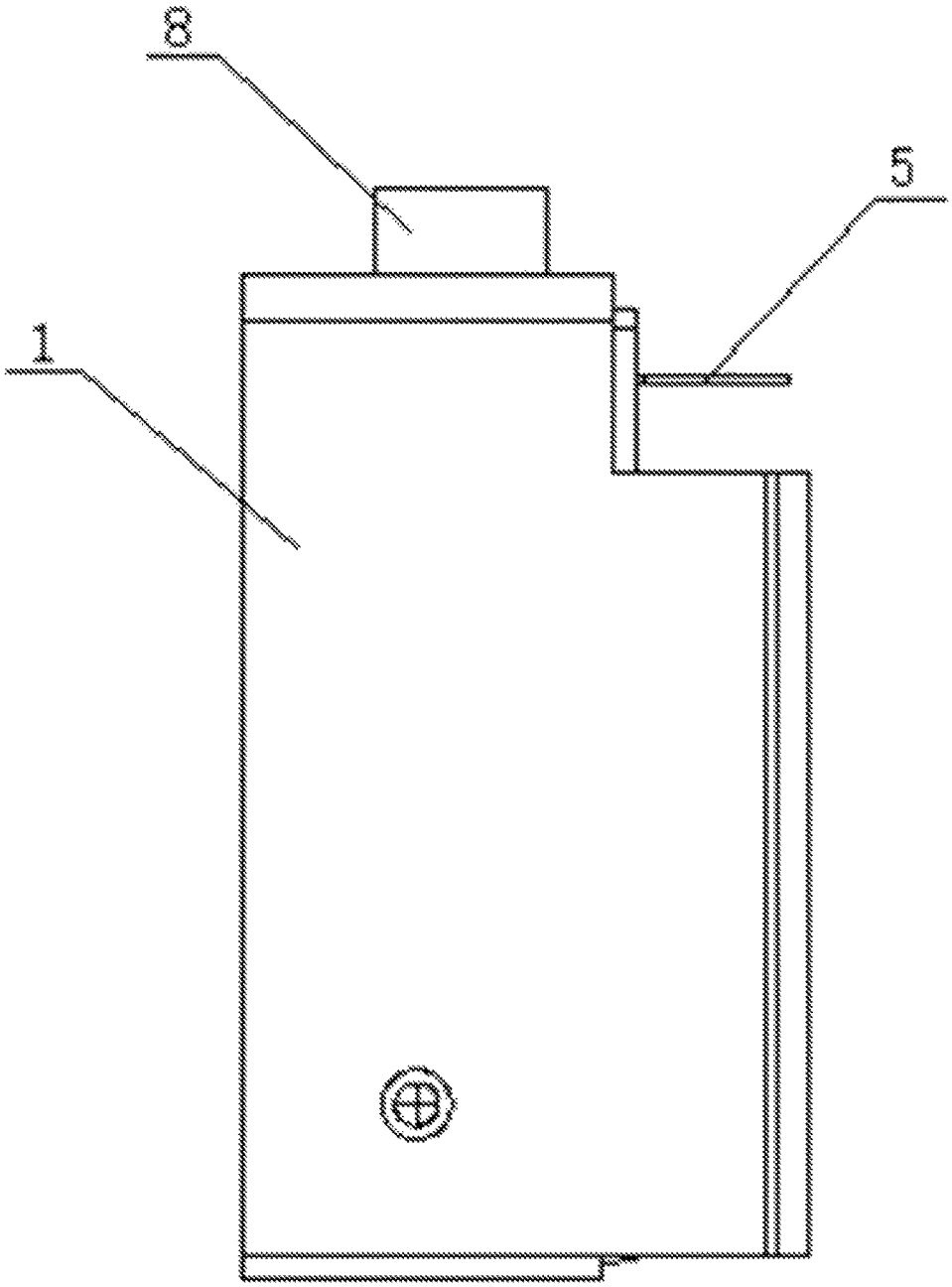
FIG. 2 is a side view of FIG. 1.

Numeral references in the figures label the following components of the present disclosure: 1. housing; 2. fixed iron core; 3. movable iron core; 4. electromagnetic coil; 5. paddle; 6. closed spring; 7. vibration sensing mechanism; 8. shaft sleeve; 9. balance spring; 10. stopping end; 11. balancing end; 12. rotation shaft; 13. bolt assembly; 14. dividing baffle; 15. mounting hole; 16. block; 17. U-shaped groove; 18. safe box door; 19. key reading device; 20. gap.

DETAILED DESCRIPTION OF THE PREFERRED EMBODIMENTS

In combination with the following embodiments and Figs, the present disclosure is further described hereafter.

In an embodiment, as shown in FIGS. 1 to 6, an electromagnetic opening device for a safe deposit box comprises a housing 1. A fixed iron core 2, a movable iron core 3, an electromagnetic coil 4, a paddle 5, a closed spring 6 coiled around the movable iron core 3, and a vibration sensing mechanism 7 are disposed in the housing 1. A bottom end of the movable iron core 3 is engaged with the fixed iron core 2. A shaft sleeve 8 sleeves a top end of the movable iron core 3 and extends outside of the housing 1 through a through hole defined in the housing 1. The vibration sensing mechanism 7 comprises a sensing block and a balance spring 9. The sensing block has a stopping end 10 and a balancing end 11 located on two opposite sides of the movable iron core 3 respectively. The balance spring 9 is disposed between a bottom of the balancing end 11 and the housing 1. A bottom of the stopping end 10 is rotationally connected onto the housing 1 through a rotation shaft 12. When the sensing block compresses the balance spring 9 through the rotation of the rotation shaft 12, the stopping end 10 is driven to abut against the bottom surface of the shaft sleeve 8.

Figure 3:
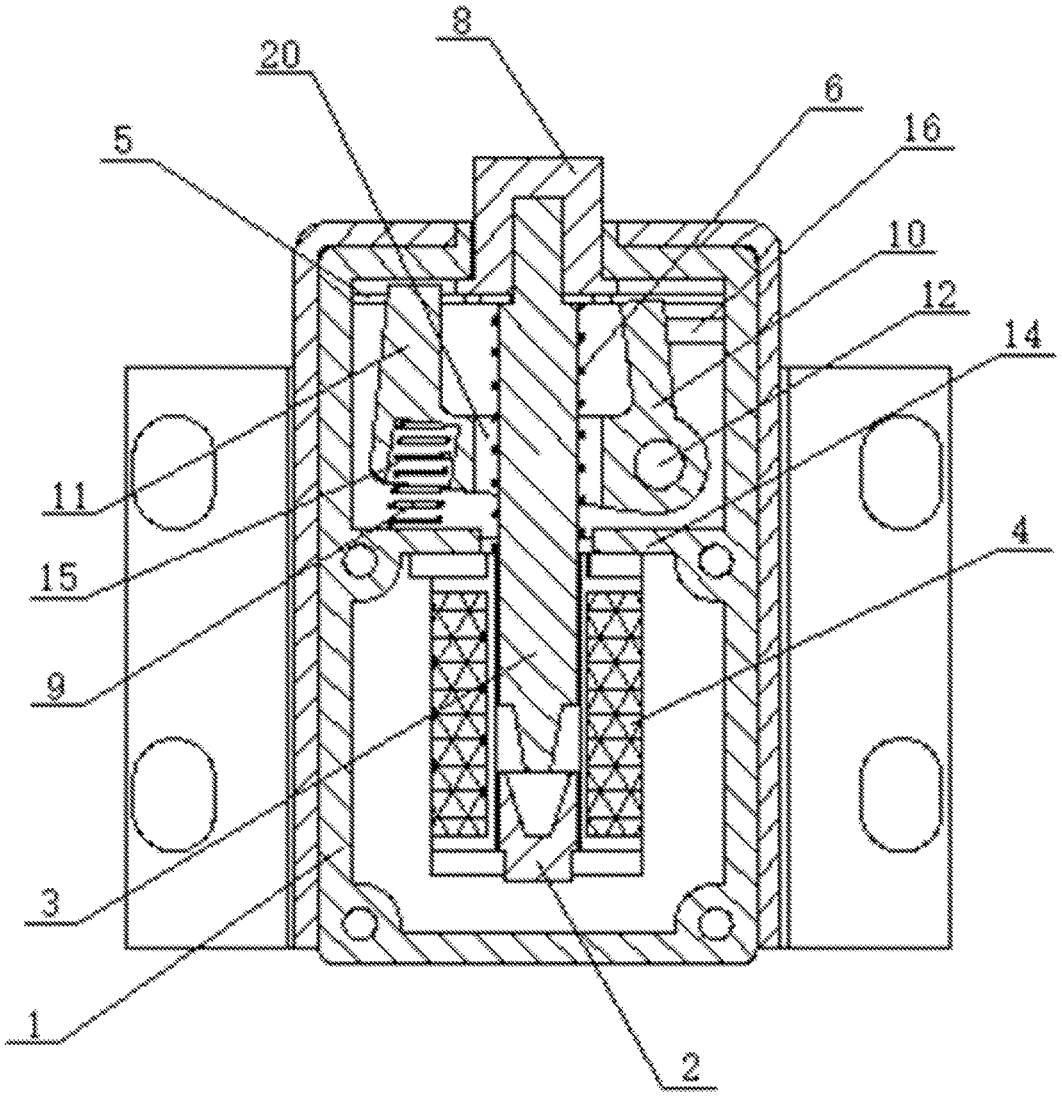
FIG. 3 is a cross-sectional view of FIG. 1.

As shown in FIG. 3, a central dividing baffle 14 is provided on a cavity of the housing 1. The vibration sensing mechanism 7 is located above the dividing baffle 14, and the electromagnetic coil 4 and the fixed iron core 2 are located below the dividing baffle 14. A mounting hole 15 is defined at a bottom of the balancing end 11. One end of the balance spring 9 is disposed in the mounting hole 15, and the other end of the balancing spring 9 is fixed to the dividing baffle 14. The housing 1 is provided with a block 16 adjacent to the stopping end 10. A front end of the block 16 is abutted against the stopping end 10 so as to prevent reverse rotation (clockwise) of the sensing block under inertia effect, thus ensuring the normal operation of the sensing block.

Figure 4:
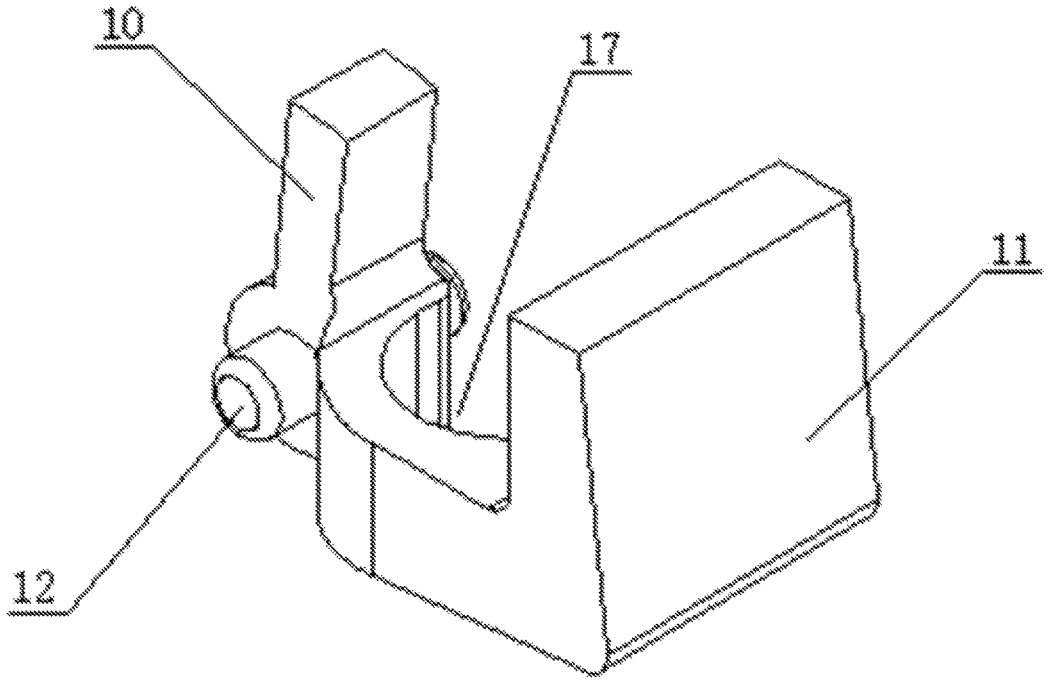
FIG. 4 is a structure diagram of a sensing block in FIG. 1.
Figure 5:
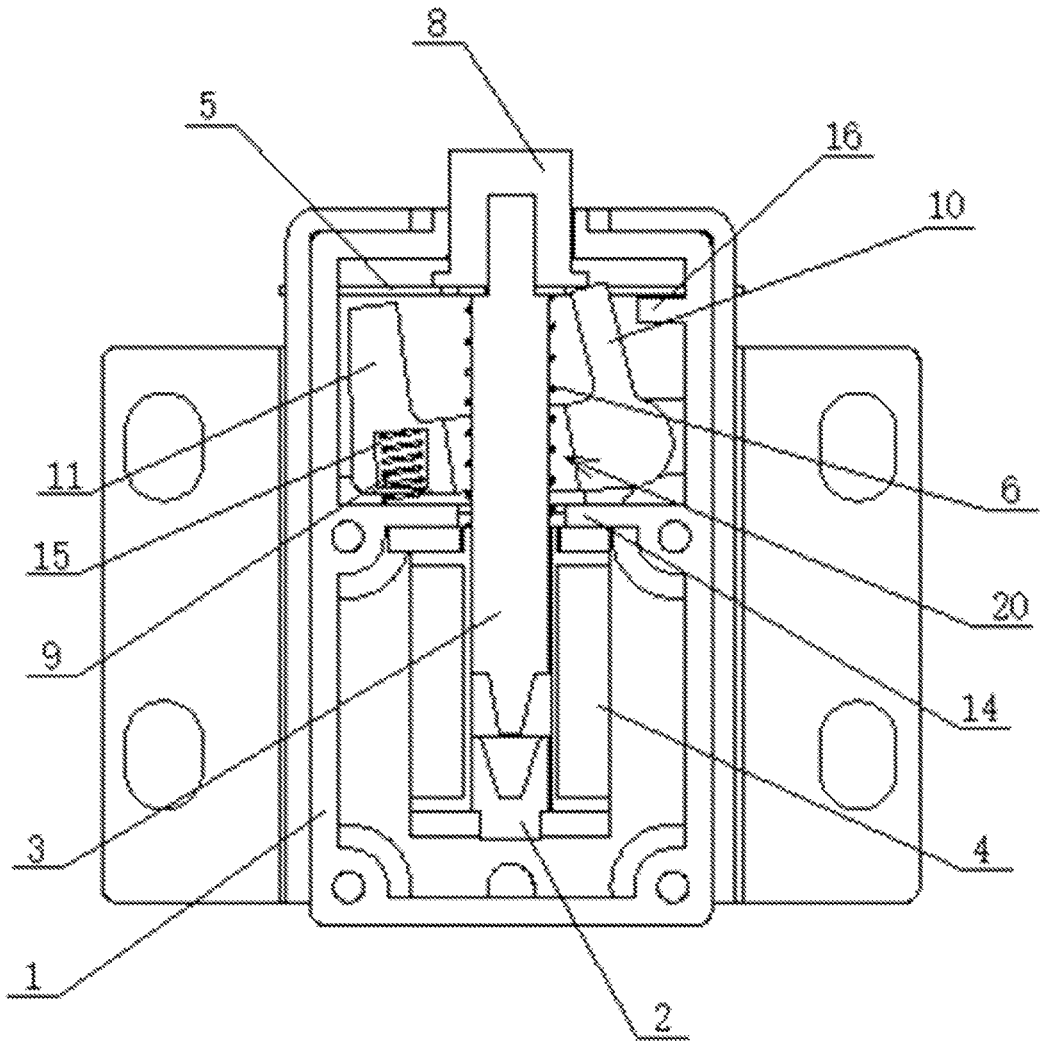
FIG. 5 is a diagram illustrating a rotation state of the sensing block under inertia effect in an embodiment of the present disclosure.

As shown in FIG. 4, the sensing block is provided with a U-shaped groove 17 (horseshoe-shaped), with the movable iron core 3 located within the U-shaped groove 17 through the sensing block. Gaps 20 are defined between sidewalls of the U-shaped groove 17 and the movable iron core 3. The stopping end 10 and the balancing end 11 are located on two opposite sides of the U-shaped groove 17, respectively. The size of the gaps 20 is configured to match with a rotational angle of the sensing block to ensure that the stopping end 10 may lift to abut against the shaft sleeve 8 when the sensing block is rotated counterclockwise under inertia effect (see FIG. 5).

Figure 6:
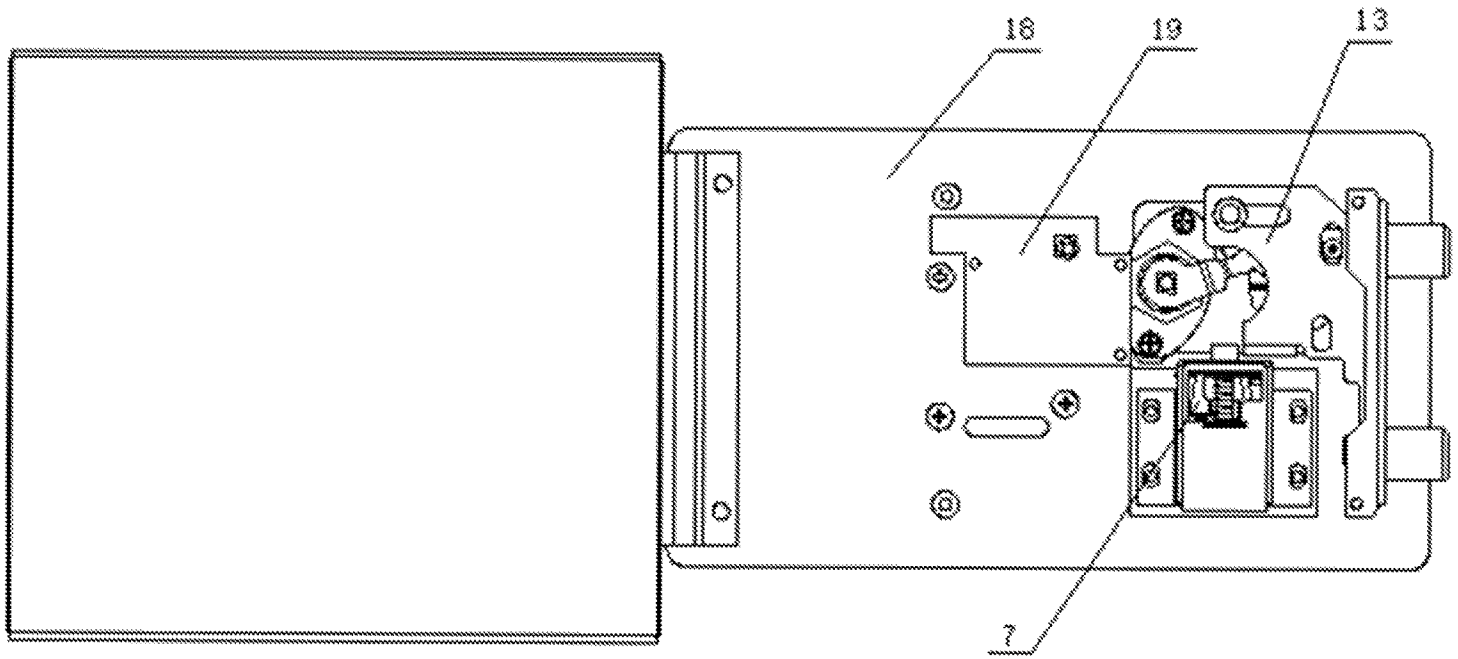
FIG. 6 is a diagram illustrating a use state of an embodiment of the present disclosure.

In use, the electromagnetic opening device of the present disclosure may be attached to a back of a safe deposit box door 18, as shown in FIG. 6. The electromagnet cooperates with a bolt assembly 13 with mechanical structure. In a locking state, the shaft sleeve 8 of the movable iron core 3 extends to outer side of the housing 1 to prevent unlocking of a spring bolt. After a key reading device 19 has read a key and finished verification, the electromagnetic opening device will be energized. When the electromagnetic coil 4 is energized, the shaft sleeve 8, the movable iron core 3, and the paddle 5 will move downward, driven by an attractive magnetic force between the movable iron core 3 and the fixed iron core 2, to compress the closed spring 6 to maintain the electromagnet in an unlocking state. Consequently, the bolt assembly 13 can be opened. In the event of shaking, knocking, shocking or the like caused by external force to the electromagnet when in a closed state, the shaft sleeve 8, the movable iron core 3, and the paddle 5 will move towards the closed spring 6. Meanwhile, the sensing block may compress the balance spring 9 under inertia effect, and rotate counterclockwise. As result, the stopping end 10 abuts against a bottom surface of the shaft sleeve to stop upward movement of the shaft sleeve 8, the movable iron core 3, and the paddle 5, thereby avoiding unlocking of the electromagnet in case of shaking, knocking, shocking or the like under inertia effect. This advantageously increases the stability and security of the safe deposit box.

What is claimed is:

1. An electromagnetic opening device for a safe deposit box, comprising:

a housing;

a fixed iron core disposed in the housing;

a movable iron core disposed in the housing and having a top end and a bottom end opposite the top end, the movable iron core capable of moving toward the fixed iron core along a primary axis of the movable iron core such that the bottom end is engaged with the fixed iron core;

a shaft sleeve configured to sleeve the top end of the movable iron core and extending outside of the housing through a through hole in the housing;

an electromagnetic coil; and a vibration sensing mechanism disposed in the housing, the vibration sensing mechanism comprising a sensing block and a balance spring, wherein the sensing block comprises a balancing end, a stopping end and a rotation shaft, wherein the balance spring is disposed between the balancing end and the housing, wherein the sensing block is provided with a U-shaped groove, wherein the movable iron core passes through the U-shaped groove with the primary axis substantially aligned with a longitudinal axis of the U-shaped groove such that the balancing end and the stopping end are respectively located on two sides of the movable iron core and that gaps are defined between sidewalls of the U-shaped groove and the movable iron core, wherein a bottom of the stopping end is rotationally connected onto the housing through the rotation shaft, and wherein, when the sensing block compresses the balance spring through a rotation of the rotation shaft, the stopping end is driven to abut against a bottom surface of the shaft sleeve while the movable iron core remains located within the U-shaped groove.

2. The electromagnetic opening device according to claim 1, wherein the housing has a block, and wherein a front end of the block engages with the stopping end.

3. The electromagnetic opening device according to claim 1, wherein a mounting hole configured to receive one end of the balance spring is defined on a bottom of the balancing end.

4. The electromagnetic opening device according to claim 1, wherein a dividing baffle is provided in a cavity defined by the housing, wherein the vibration sensing mechanism is located above the dividing baffle, and wherein the electromagnetic coil and the fixed iron core are located below the dividing baffle.

5. The electromagnetic opening device according to claim 4, wherein a bottom of the balance spring is fixed to the dividing baffle.

6. The electromagnetic opening device according to claim 1, further comprising a paddle.

7. The electromagnetic opening device according to claim 1, further comprising a closed spring disposed in the housing and coiled around the movable iron core.

* * * * *